US007464730B2

(12) United States Patent
Mettler

(10) Patent No.: US 7,464,730 B2
(45) Date of Patent: Dec. 16, 2008

(54) WEAVING HEDDLE FOR JACQUARD WEAVING MACHINE

(75) Inventor: Franz Mettler, Wollerau (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/907,034

(22) Filed: Oct. 9, 2007

(65) Prior Publication Data

US 2008/0083471 A1 Apr. 10, 2008

(30) Foreign Application Priority Data

Oct. 6, 2006 (EP) ..... 06021003

(51) Int. Cl.
*D03C 9/04* (2006.01)
*D03C 9/02* (2006.01)
*D03C 3/00* (2006.01)

(52) U.S. Cl. ..... 139/93; 139/59; 139/92

(58) Field of Classification Search ..... 139/52, 139/53, 93–96
See application file for complete search history.

(56) References Cited

U.S. PATENT DOCUMENTS 887,102 A * 5/1908 Lackey ..... 139/96
997,283 A * 7/1911 Kaufmann ..... 139/96
1,413,949 A * 4/1922 Wagner ..... 139/94
1,648,139 A * 11/1927 Machon ..... 139/55.1
1,930,151 A * 10/1933 Smith ..... 139/94
1,944,516 A * 1/1934 King ..... 139/94
2,019,822 A * 11/1935 Kaufmann ..... 139/94
2,249,390 A * 7/1941 Mahler ..... 139/93
3,049,151 A * 8/1962 McFetters ..... 139/93
3,960,182 A * 6/1976 Schwarz ..... 139/91
4,355,665 A * 10/1982 Ramseier et al. ..... 139/96
4,790,357 A * 12/1988 Kramer ..... 139/91

(Continued)

FOREIGN PATENT DOCUMENTS

CH 631 755 A5 8/1982

(Continued)

OTHER PUBLICATIONS http://encyclopedia.thefreedictionary.com/
Fiber+reinforced+plastic, definition of fiber reinforced plastic.*

(Continued)

*Primary Examiner*—Bobby H Muromoto, Jr.
(74) *Attorney, Agent, or Firm*—Fitch, Even, Tabin & Flannery; Norman N. Kunitz

(57) ABSTRACT

A heddle for jacquard machines essentially consisting of fiber-reinforced plastic material, with a thread eye formed by a mail or thread eyelet member (12) of a harder material. The heddle body comprises two legs (3, 4). Between the relatively wide thread eye region (5) and the legs (3, 4), ramp sections (6) are provided on the mail, which sections have a length that is greater than the length of the thread eye (1). Preferably, the length is greater than twice the longitudinal extension of the thread eye, and in most cases, is between 10 and 30 mm. As a result of this measure, the wear of the plastic material in the vicinity of the thread eye (13) is kept minimal enough that neither any damage to the stiffening fibers (22) in the body of plastic material nor any damage to the warp threads needs to be feared.

18 Claims, 2 Drawing Sheets

U.S. PATENT DOCUMENTS

| | | | | |
|---|---|---|---|---|
| 5,042,534 | A * | 8/1991 | Pezzoli et al. | 139/91 |
| 5,052,446 | A * | 10/1991 | Gysin | 139/93 |
| 5,092,370 | A * | 3/1992 | Anderson | 139/93 |
| 5,178,192 | A * | 1/1993 | Koch | 139/91 |
| 5,348,055 | A * | 9/1994 | Kramer | 139/93 |
| 5,474,110 | A * | 12/1995 | Mettler | 139/93 |
| 6,105,623 | A * | 8/2000 | Tonz et al. | 139/93 |
| 6,230,756 | B1 * | 5/2001 | Baumann et al. | 139/93 |
| 6,283,163 | B1 * | 9/2001 | Kagi | 139/93 |
| 6,732,767 | B2 * | 5/2004 | Baumann | 139/92 |
| 6,883,554 | B2 * | 4/2005 | Baumann et al. | 139/93 |
| 7,036,532 | B2 | 5/2006 | Bauder et al. | |
| 2003/0145898 | A1 * | 8/2003 | Bassi et al. | 139/95 |
| 2003/0150506 | A1 * | 8/2003 | Baumann et al. | 139/93 |
| 2004/0244862 | A1 * | 12/2004 | Gesing | 139/93 |

FOREIGN PATENT DOCUMENTS

| | | | |
|---|---|---|---|
| DE | 101 24 022 | A1 | 12/2002 |
| EP | 0 403 429 | A1 | 12/1990 |

OTHER PUBLICATIONS http://www.thefreedictionary.com/mail, definition of the term "mail".*

* cited by examiner

WEAVING HEDDLE FOR JACQUARD WEAVING MACHINE

CROSS REFERENCE TO RELATED APPLICATION

This application claims the priority of European Patent Application No. 06 021 003.6, filed on Oct. 6, 2006, the subject matter of which, in its entirety, is incorporated herein by reference.

BACKGROUND OF THE INVENTION

The invention relates to a weaving heddle which is suitable, in particular for a jacquard weaving machine.

Jacquard weaving machines use, as a rule, weaving heddles that are resiliently suspended on one end. A cord, the so-called harness cord, is attached to the other end, said cord leading to a jacquard machine. This machine applies a specific tension to the cords, as a result of which the heddles are moved individually and independently of each other. Regarding details of jacquard weaving machines, reference is made to document DE 101 24 022 A1. This type of heddle actuation has reached its limits, considering the operating speeds of modern weaving machines. In order to control the heddle and its mass, increasingly stronger springs must be used with increasing speed. This stresses jacquard weaving machines unnecessarily. In addition, the potential use of stronger springs is limited due to the confined spatial conditions.

For example, CH Patent 631 755 has already suggested to produce a weaving heddle of plastic material, in which case this weaving heddle was not intended for jacquard weaving machines but for use on heald shafts that comprise two parallel heddle-mounting rails on which the weaving heddles are held—with play—by their end eyes. The weaving heddle known from this document comprises a body of plastic material in which a mail is set so as to form an eye for a thread. This mail consists of an annular body of a material which is harder than the plastic material. On its outside circumference, this body has a continuous, flat groove, whereby said body extends into said groove. In addition, the body of plastic material extends around the edges of the mail in order to secure it in place in a form-closed manner.

This type of weaving heddles is not directly suitable for jacquard weaving, in which the weaving heddles are permanently tensioned between the harness cord and the spring.

Furthermore, document EP 0 403 429 A1 suggests a weaving heddle for use on heald shafts that have two heddle-mounting rails, on which the ends of the heddles are seated. The heddles can slide freely on the heddle-mounting rails, i.e., they display great lateral movability. Consequently, the weaving heddles can yield to the warp threads passing between said heddles, thus restricting the friction between the warp threads and the weaving heddles. The weaving heddles known from said literature reference consist of a plastic/fiber composite material. In order to produce this material, a tubular braid is embedded in a plastic material matrix. This tubular braid is covered by the plastic material. In order to form a thread eye, a mail is set into the thusly formed heddle body.

Referring to the weaving heddles of the two documents CH 631 755 and EP 0 403 429, the heddle body is thicker in the region of the mail, whereby two straight legs extend from said mail in this thicker region. The transition from one leg to the thicker thread eye region is formed by a short ramp-like section. This section, in particular, is subject to wear, i.e., material abrasion, when warp threads graze along the heddle. If, due to such wear, the fibers of the plastic/fiber composite material are exposed, the reinforcement fibers projecting from the plastic body can thus damage the warp threads.

Considering the above, it is the object of the invention to provide an improved, light-weight heddle suitable for jacquard weaving.

SUMMARY OF THE INVENTION

The above object generally is achieved according to the present invention with a heddle that comprises a heddle body consisting of a plastic material body in which non-metallic fibers are embedded. The thread eye is formed by a mail which consists of a material having a hardness that is greater than the hardness of the plastic material. The mail is set in the plastic material body. The special feature is the light-weight heddle body which has, in the transition region between the legs and the thread eye section, a ramp section having a length—measured in the direction of the leg—that is greater than the length of the thread eye measured in the same direction.

Considering this measure, a particularly flat transition region is achieved between the small, preferably round, cross-section of the leg and the larger flattened cross-section of the thread eye region. Warp threads grazing the leg, the ramp section and the thread eye section thus exert only a minimal pressure on the plastic material surface of the heddle. The heddle wear is kept within manageable limits or is avoided. The risk that, due to the abrasion of the upper layer of plastic material, reinforcement fibers are exposed little by little, which then could damage the warp threads, is minimal or is being eliminated.

It is possible to embed the fibers as short fibers in the plastic material, whereby they do not need to have a specific preferred orientation. The flat slope of the ramp section makes this possible, even though, frequently, only very minimal coverage of the fibers by the plastic material is provided.

It is considered advantageous to use long fibers which preferably are oriented in the direction of the leg and not transverse to the leg or to the thread eye. This type of fiber arrangement is based, for example, on the embedding of fibers that are not twined, twisted or woven, for example, so-called rovings, in the plastic material. In this case, the fibers have a preferred orientation with respect to each other, whereby all the fibers are aligned essentially parallel to each other. Minor deviations from this parallel orientation occur at most in the region of the ramp section. The acute angle subtended by the fibers among each other, in so doing, is as large as the acute angle formed by the ramp section itself. Deviating therefrom, the fibers at the mail can be arranged so as to follow the circumferential direction of the mail. However, this is restricted to the inner region of the plastic material body which, even after severe wear and material abrasion, is never exposed.

Preferably, the cross-section of the legs is round having a rounding radius R1. The ramp section and the thread eye section are preferably also rounded on their narrow sides. This is preferably achieved with a rounding radius of R2 and R3, respectively, said radii corresponding to the rounding radius R1. The cross-section of the ramp section and the flattened region are preferably oval, whereby said region is limited by two opposing parallel straight pieces and by two opposing circular arcs. This results in a uniform curvature of the lateral edges or surfaces that face the warp threads running between the heddles.

The heddles are made of a suitable plastic material, for example, a thermoplastic material, preferably, however, of a curable duroplastic synthetic material. This material may consist, for example, of a two-component plastic material, for example, an epoxide resin. Heat-curable two-component plastic materials, plastic materials that are curable with ultraviolet radiation, or even chemically activated two-component plastic materials can be used. Preferably, the mail is set in the heddle body prior to the solidification of the plastic material and thus bonded thereto in a substance-closed and form-closed manner. An adhesive is not required for attaching the mail. The heddle in accordance with the invention can be manufactured by injection moulding or by a transfer moulding. Preferably, continuously running reinforcement fibers are provided, said fibers extending from one leg over the mail into the other leg. For manufacturing purposes, the fiber tow that is used is first impregnated with a not yet fully cured plastic material. The mail is set in this fiber tow at the desired point. The heddle receives its final form by placement and optional compression in a mould and, for example, by heat-curing or by being cured with ultraviolet radiation.

The end of the heddle is preferably shaped in such a manner that it can be easily attached to a harness cord. To do so, the end of the heddle body is configured as an eyelet or as a hook, for example. Other shapes suitable for attaching a harness cord are possible. The second, opposite, end of the heddle body may be configured in the same manner if a cord is to be attached there as well. If a pull-down spring is to be attached, the plastic material may also be shaped in such a manner that a hook or screw thread is formed onto which the end of the pull-down spring can be screwed.

The ramp section forms a gentle transition between the small cross-section of the leg and the larger cross-section of the heddle eye. This ramp section may be configured as a straight piece or have the shape of an S. Preferably, this ramp section has a length of at least 10 mm. In the case of most preferred embodiments, the length of the ramp section is greater and may be up to 30 mm.

Developments of the invention relate to a heddle with a mail, which not only forms the thread eye but also at least parts of the outside surface of the heddle. For example, the mail may be enlarged to form a longitudinal part that comprises the thread eye and, in addition, attachment options for the tow formed of fibers and the plastic material, respectively. Referring to a preferred embodiment, this enlarged mail is provided with the ramp-shaped regions of the heddle and, for example, on the narrow sides or on the flat sides, with a longitudinal groove, which receive the respective part or the leg of the body of plastic material. In addition, it is possible to configure the mail as the center piece of the heddle body with attachment options for the two legs. The attachment options may be configured as openings, through which extend the fibers of the leg consisting of plastic material.

Suitable reinforcement fibers are glass fibers, aramid fibers, protein fibers or carbon fibers. As a result of the fiber reinforcement, the heddles are imparted with a stiffness that allows the use in jacquard machines.

Additional details of advantageous embodiments of the invention are the subject matter of the drawings, the description and the claims. Hereinafter, exemplary embodiments of the invention are described. The description is restricted to the explanation of essential aspects of the invention and miscellaneous situations, whereby modifications are possible. As is usual, smaller not-described details are obvious to those skilled in the art based on the drawings, said drawings completing the description of the figures. In order to illustrate essential details, it may be that certain parts of the drawings are depicted in an exaggeratedly large manner.

DETAILED DESCRIPTION OF THE INVENTION

Figure 1:
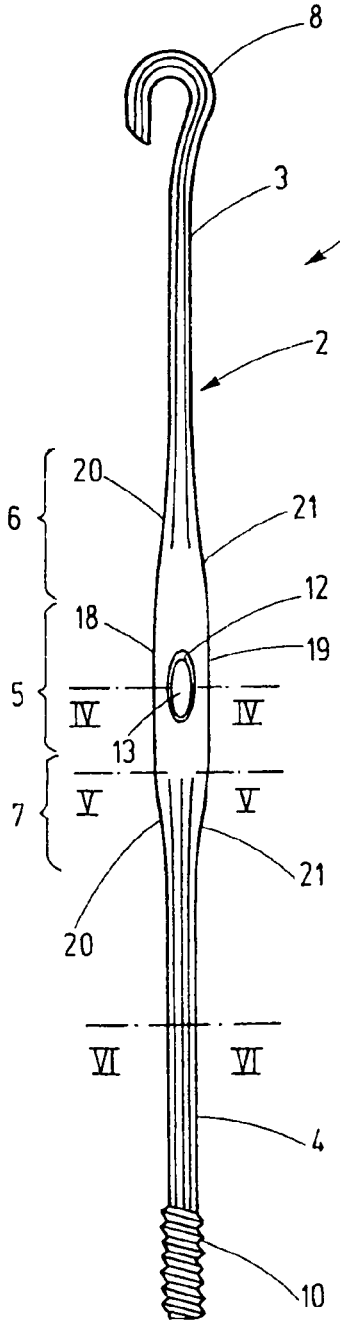
FIG. 1 is a simplified side view of a heddle in accordance with the invention.

FIG. 1 shows a heddle 1 for a jacquard weaving machine. The heddle 1 has a heddle body 2 with two, preferably straight, legs 3, 4, which are in alignment with each other and, between them, include a thread eye section 5 and the ramp sections 6, 7. The legs 3, 4 may have the same or different diameters and cross-sections. Preferably, they have a round cross-section, as is shown, for example, in FIG. 6 with reference to the cross-section of leg 4. The leg 4 is essentially cylindrical and has a circular cross-section with a radius $R_1$.

Figure 2:
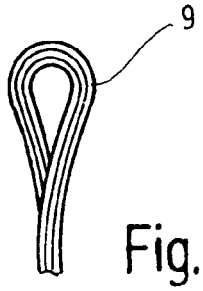
FIG. 2 is a modified embodiment of the end of the heddle in accordance with FIG. 1.
Figure 7:
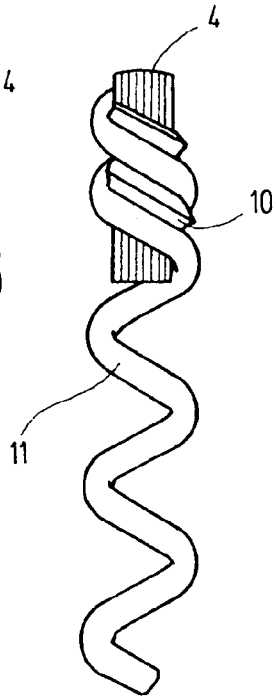
FIG. 7 shows one end of a leg of the heddle in accordance with FIG. 1, in connection with an attached spring.

The ends of the legs 3, 4 are configured for the connection with additional devices, such as, for example, harness cords or tension springs. For example, the upper end of the leg 3 is provided with a hook 8. Alternatively, it may terminate in an eyelet 9 as is shown, for example, by FIG. 2. The lower end of the leg 4 may also be configured as a hook or as an eyelet. In the preferred case, however, it has a screw thread 10, which—as indicated, for example in FIG. 7—can be screwed together with the end of a tension spring 11.

Figure 3:
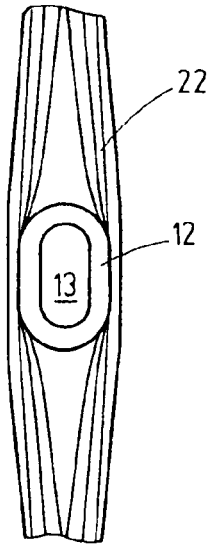
FIG. 3 is an enlarged view of the thread eye region of the heddle in accordance with FIG. 1.
Figure 4:
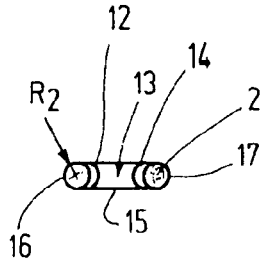
FIG. 4 is a sectional view, along line IV-IV in FIG. 1, of the thread eye region of the heddle in accordance with FIG. 1.

The thread eye section 5 contains a mail or thread eye member 12, as is obvious, for example, from FIG. 3. The mail is an annular body of a hard, wear-proof material, for example ceramic. The ceramic may be a sintered ceramic, a reactive ceramic, an oxide ceramic or the like. Furthermore, the mail 12 may consist of a cermet, a hard metal, a hardened steel ring or the like. Furthermore, the mail has a thread guide opening 13 which may be elliptical or oval. As is illustrated by FIG. 4, the opening 13 of the mail 12 is preferably rounded and free of sharp edges. Measured in longitudinal direction of the legs 3, 4, said mail preferably has a height that is greater than its width measured in a direction transverse to said height. On its outside circumference, the mail 12 defines a continuous groove, into which extends the heddle body 2.

The thread eye section 5 has an oval cross-section. It is defined by two parallel-oriented edges 14, 15 having the form of straight flat sections which are connected on their ends by circular arcs 16, 17. The circular arcs 16, 17 have a rounding radius R2, which, preferably, corresponds to the rounding radius R1.

Each of the edges 16, 17 follows a circular arc. In cross-section, they represent the lateral sides 18, 19 of the thread eye region 5 along intersection line IV-IV. The sides 18, 19, at that point, represent cutouts of the generated surface of a cylinder. The sides 18, 19 visible in FIG. 1 are oriented parallel with respect to each other.

The two ramp sections 6, 7 may be the same or, as illustrated, may be different regarding their length. Preferably, it is within a range of 10 and 30 mm, whereas the distance of the sides 18, 19 from each other is in most cases smaller than 10 mm. The ramp sections 6, 7 have a length which is greater than, preferably significantly greater than, the height of the thread guide opening 12 measured in the same direction. Preferably, the length of the ramp sections 6, 7 is, in each case, at least twice as large, optimally at least three times as large as the height of the thread opening 13.

Figure 5:
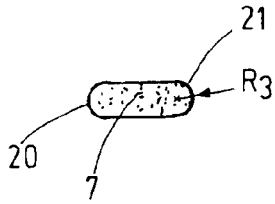
FIG. 5 is a sectional view, along line V-V in FIG. 1, of the ramp section of the heddle in accordance with FIG. 1.
Figure 6:
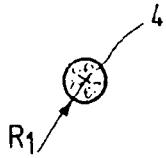
FIG. 6 is a sectional view, along line VI-VI in FIG. 1, of the leg of the heddle in accordance with FIG. 1.

Preferably, the ramp regions 6, 7 have a thickness that, in FIG. 1, is constant when measured perpendicular to the plane of projection, i.e., in the direction of the thread guide opening 13. In contrast, the width of the ramp region 6 or 7 to be measured in a direction transverse to the thread guide opening 13 increases from the leg 3 or 4 toward the thread eye section 5. In so doing, the ramp sections 6, 7 adjoin the legs 3, 4, as well as the thread guide section 5, in a flush manner. FIG. 5 shows a section of the ramp section 7 along the line of intersection V-V. FIGS. 5 and 6 are on the same scale. It is obvious that the ramp sections 6, 7 have a curvature R3 on their sides 20, 21, said curvature corresponding to the curvatures R1 and R2. (FIG. 4 is drawn on a different scale than FIGS. 5 and 6.)

The body 2 of the heddle 1 is a body of plastic material, which, as indicated in FIGS. 1 through 6, contains fibers 22 for reinforcement. These fibers extend essentially parallel to a longitudinal direction that is pre-specified by the legs 3, 4 and connects the eyelet 8 with the screw thread 10. In so doing, the fibers are preferably long fibers, all of which being oriented in longitudinal direction. An exception regarding the orientation exists in longitudinal direction, as shown by FIG. 3, at most in the region of the ramp sections 6, 7, as well as in the region of the thread eye section 5. The reinforcing fibers 22 extend around the mail 12 in this case. However, also in this case, the fibers are essentially oriented in longitudinal direction. At any rate, no fiber is arranged in transverse direction. The fibers 22 are embedded in the plastic material and covered by said material. For example, the plastic material is an epoxide resin or another duroplastic synthetic material. Alternatively, a thermoplastic synthetic material may be used. The mail 12 is embedded in the body of plastic material and bonded thereto in a form-closed manner. The bond is produced without additional cement in that the mail is initially set into the not fully cured plastic material, whereupon the plastic material is fully cured.

The fibers 22 may be glass fibers, mineral fibers, carbon fibers or even protein fibers, e.g., such as those of spider silk.

The small acute angle between the sides 21, 22 of preferably less than 20degrees ensures that the occurring wear of the layer of plastic material on the sides 18, 19, 20, 21 remains relatively minimal and that the fibers are rarely exposed, even after the plastic material layer has worn off. As a result of the longitudinal orientation of all the fibers it is achieved that, even if a part of the covering layer of plastic material is worn off, the fibers 22 remain intact and continue to ensure the tensile strength of the heddle 1. In addition, due to the deliberate omission of any transverse fibers, it is ensured that the warp threads moving along the potentially exposed fibers are not damaged.

Figure 8:
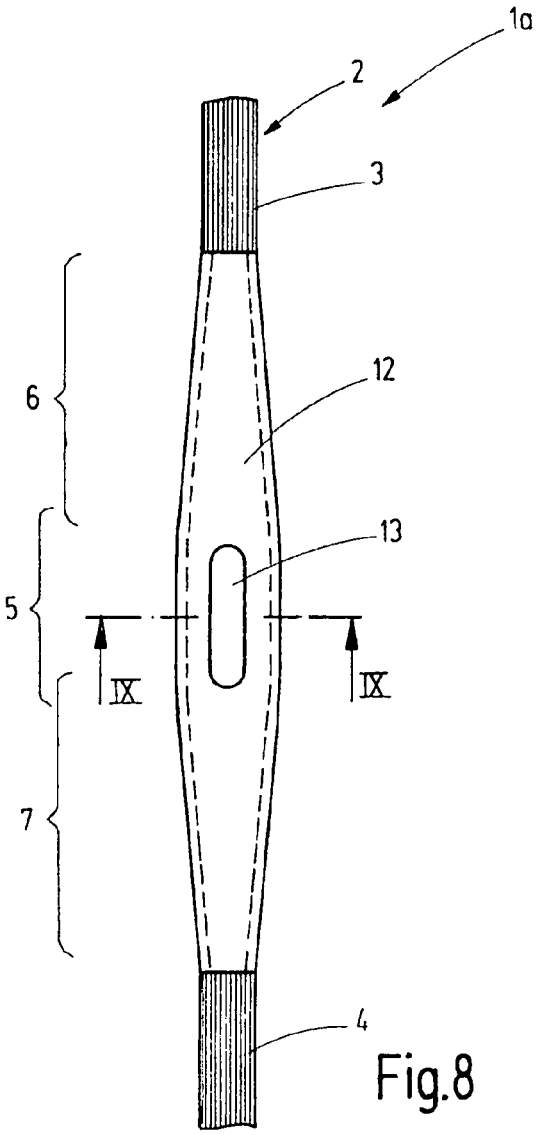
FIG. 8 is a sectional side view of a modified embodiment of the heddle in accordance with the invention.
Figure 9:
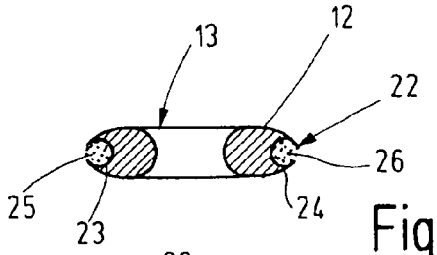
FIG. 9 is a sectional view, along line IX-IX of the thread eye, of the heddle in accordance with FIG. 8.

FIGS. 8 and 9 illustrate a modified heddle 1*a* that has been optimized in view of the use of aggressive warp yarns, for example, amid fibers. This heddle, again, has the legs 3, 4, to which the description above applies analogously. Again, the ramp sections 6, 7 are clearly longer than the longitudinal extension of the thread guide opening 13 of the mail 12. However, the ramp sections 6, 7, as well as the thread eye section 5, are formed in that the mail is enlarged to create a longitudinal part. This part contains, on the one hand, the thread guide opening 13, as well as, on the other hand, extensions which form the ramp sections 6, 7. As is obvious, in particular from FIG. 9, they may be provided with the grooves 23, 24, through which extend the legs 25, 26 of the body of plastic material.

As is obvious from FIGS. 8 and 9, the legs 25, 26 connect the legs 3, 4 with each other and hold the mail 12 between them. In so doing, they represent a part of the heddle body 2. Preferably, the reinforcement fibers 22 extend from one leg 3 to the other leg 4, whereby they either extend through the leg 25 or through the leg 26. The legs 25, 26 are largely embedded in the grooves 23, 24 and thus protected by the hard material of the mail 12 against damage by the abrasive warp threads.

Figure 10:
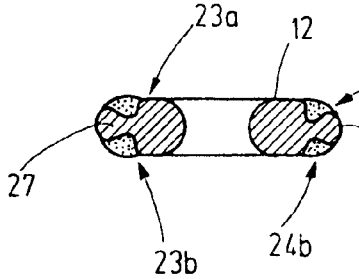
FIG. 10 is a sectional view, along line IX-IX of the thread eye, of modified form of the weaving heddle in accordance with FIG. 8.

Referring to a modified embodiment, the corresponding grooves 22*a*, 23*b*, 24*a*, 24*b* are provided in accordance with FIG. 10, whereby strips 27, 28 of the mail 12 project between said grooves. The strips 27, 28 form ribs extending along the mail 12, said ribs representing guide or abutment surfaces for the warp threads that move past the heddles. Again, corresponding sections of the heddle body 2 are located in the grooves 23*a*, 23*b*, 24*a*, 24*b*, said grooves holding the mail 12 in a form-closed and substance-closed manner.

Figure 11:
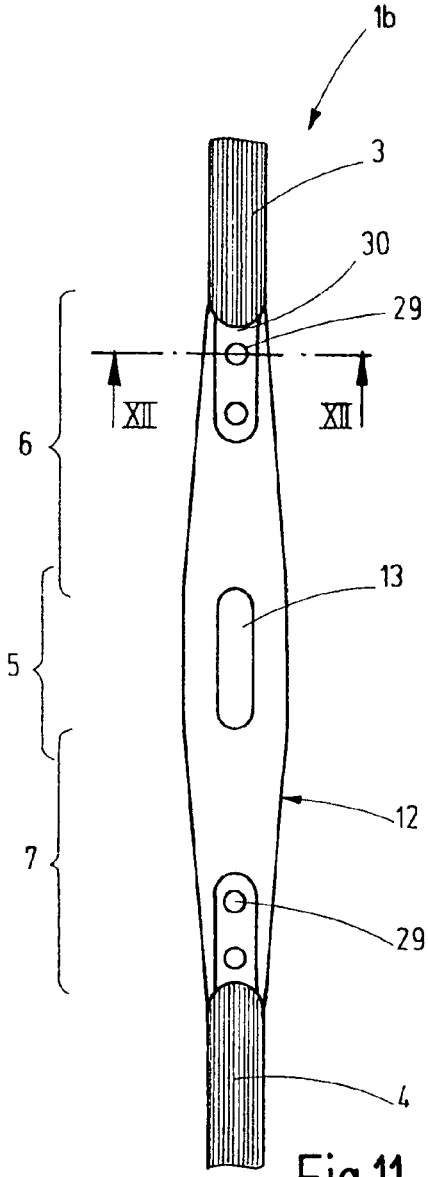
FIG. 11 is a sectional side view of another embodiment of the heddle in accordance with the invention.
Figure 12:
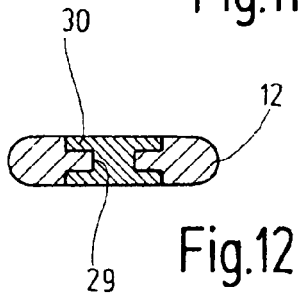
FIG. 12 is a sectional view, along line XII-XII, of the heddle in accordance with FIG. 11.

FIGS. 11 and 12 show a further modified embodiment of a heddle 1*b*. In this case, the mail 12 by itself forms the ramp sections 6, 7 and the thread eye section 5. The legs 3, 4 are attached to the mail 12. To do so, said mail has—on its narrow ends facing away from the thread eye 13—recesses with attachment openings 29. Extensions 30 of the legs 3 or 4 may extend into said latter openings, whereby the plastic material, including the fibers, may penetrate the attachment openings 29. This heddle can be manufactured, in particular, by injection moulding. The attachment openings 29 and recesses provided on the end of the mail are disposed to anchor the injection moulding material. The heddle is manufactured in that the mail is placed in the injection moulding machine and subsequently surround-sprayed.

Referring to this and to the other embodiments, it applies that the body of plastic material 2 and the legs 3, 4, respectively, can optionally also be manufactured of a plastic material which comprises—instead of the continuously extending reinforcement fibers—short fibers, so-called whiskers. The result with respect to the load-bearing capacity of the heddle is then slightly less, in which case it is sufficient for some applications.

An inventive heddle for jacquard machines essentially consists of fiber-reinforced plastic material, whereby the thread eye is formed by a mail 12. The heddle body comprises two legs 3, 4. Between the relatively wide thread eye region 5 and the legs 3, 4, ramp sections 6, 7 are provided, which sections have a length that is greater than the length of the thread eye 13. Preferably, the length is greater than twice the longitudinal extension of the thread eye. In most cases, said length is between 10 and 30 mm. As a result of this measure, the wear of the plastic material in the vicinity of the thread eye 13 is kept minimal enough that neither any damage to the stiffening fibers 22 in the body of plastic material nor any damage to the warp threads needs to be feared.

LIST OF REFERENCE NUMBERS

1. Heddle, 1*a*, 1*b*
2. Heddle body
3 Leg
4 Leg
5 Thread eye section
6 Ramp section
7 Ramp section
8 Hook
9 Eyelet
10 Screw thread
11 Tension spring
12 Mail
13 Thread guide opening
14 Edge
15 Edge
16 Circular arc
17 Circular arc
18 Side
19 Side
20 Side
21 Side
22 Fibers
23 Groove, 23*a*, 23*b*
24 Groove, 24*a*, 24*b*
25 Leg
26 Leg
27 Strip
28 Strip
29 Attachment opening
30 Extension

The invention claimed is:

1. A heddle for a jacquard weaving machine, comprising:

first and second legs consisting of plastic material in which non-metallic fibers are embedded, and each having a round cross-section;

a mail having a thread eye and being formed of a material with a hardness greater than the hardness of the plastic material, said mail being disposed between and attached to said legs so that said legs extend away from the mail in opposite longitudinal directions; and wherein said mail has a central thread eye section with a flat cross-section and a width greater than the width of each of said legs, and, in a transition region extending from the thread eye section to each respective leg, a ramp section having a flattened cross-section that increases in width from the respective leg toward the thread eye section and has a length, measured in a longitudinal direction of the leg, that is greater than the length of the thread eye measured in the same direction.

2. A heddle in accordance with claim 1, wherein the length of each ramp section is between 10 and 30 mm.

3. A heddle in accordance with claim 1, wherein the mail has a respective groove extending along each of its longitudinally extending edges, and the mail is attached to the respective legs by extended portions of said legs that extend along said grooves and connect the two legs together.

4. A heddle in accordance with claim 3, wherein the fibers are long fibers which are exclusively oriented in the longitudinal direction of the heddle legs, and which extend along said grooves between said respective two legs.

5. Heddle in accordance with claim 1, wherein the cross-section of the ramp section or of the thread eye section has an oval shape so as to be limited by two opposing straight, parallel edges and by two opposing circular arcs.

6. Heddle in accordance with claim 1, wherein the plastic material is a curable duroplastic material.

7. Heddle in accordance with claim 3, wherein: the plastic material is a curable duroplastic material; and the mail, which was placed between the leg portions prior to the solidification of the plastic material, is attached to the legs without cement.

8. Heddle in accordance with claim 1, wherein the plastic material is a thermoplastic synthetic material.

9. Heddle in accordance with claim 3, wherein: the plastic material is a thermoplastic synthetic material; and the mail, which was placed between the leg portions prior to the solidification of the plastic material, is attached to the legs without cement.

10. Heddle in accordance with claim 1, wherein the fibers are long fibers which are exclusively oriented in the longitudinal direction of the heddle.

11. Heddle in accordance with claim 1, wherein the fibers are short fibers.

12. Heddle in accordance with claim 11, wherein the fibers are randomly arranged in the heddle.

13. Heddle in accordance with claim 3, wherein the leg portions are enclosed by the grooves of the mail.

14. Heddle in accordance with claim 1, wherein the mail consists of glass, aluminum oxide, ceramic, hard metal or super-hardenable steel.

15. Heddle in accordance with claim 1, wherein the fibers are glass fibers, aramid fibers or carbon fibers.

16. Heddle in accordance with claim 1, wherein the respective legs are separate individual members that are attached to opposite ends of the mail.

17. Heddle in accordance with claim 16, wherein said mail, for attachment of a leg, has respectively at least one attachment opening at each longitudinal end.

18. Jacquard harness comprising a heddle in accordance with claim 1.

* * * * *